US006308612B1

(12) United States Patent
Emanie et al.

(10) Patent No.: US 6,308,612 B1
(45) Date of Patent: Oct. 30, 2001

(54) HYDRAULIC LEVELING CONTROL SYSTEM FOR A LOADER TYPE VEHICLE

(75) Inventors: Faraidoon Fred Emanie, Rockford; Brian Andrew Frey, Freeport, both of IL (US)

(73) Assignee: Delta Power Company, Rockford, IL (US)

( * ) Notice: Subject to any disclaimer, the term of this patent is extended or adjusted under 35 U.S.C. 154(b) by 0 days.

(21) Appl. No.: 09/159,661

(22) Filed: Sep. 24, 1998

(51) Int. Cl.[7] ..... F15B 11/22
(52) U.S. Cl. ..... 91/515; 414/708
(58) Field of Search ..... 91/171, 515, 520; 414/700, 708

(56) References Cited

U.S. PATENT DOCUMENTS

| | | | | |
|---|---|---|---|---|
| 3,563,137 | | 2/1971 | Graber . | |
| 4,408,518 | | 10/1983 | Diel . | |
| 4,465,089 | | 8/1984 | Inhofer . | |
| 4,531,536 | | 7/1985 | Kosarzecki . | |
| 4,561,342 | | 12/1985 | Calvert . | |
| 4,683,802 | * | 8/1987 | Prokop et al. | 91/171 |
| 4,709,618 | | 12/1987 | Zongker . | |
| 4,723,478 | | 2/1988 | Diel . | |
| 4,799,851 | * | 1/1989 | Swanson | 91/520 |
| 4,815,357 | * | 3/1989 | Truehart | 91/171 |
| 5,447,094 | | 9/1995 | Geyler, Jr. . | |
| 5,669,282 | | 9/1997 | Tanino . | |
| 5,797,310 | | 8/1998 | Casey et al. . | |

OTHER PUBLICATIONS

Sun drawings "High Capacity Flow Divider/Combiner", pp. 7–15, submitted Sep. 9, 1994.*

* cited by examiner

*Primary Examiner*—F. Daniel Lopez
(74) *Attorney, Agent, or Firm*—Vernon J. Pillote

(57) ABSTRACT

A control system for a lift boom pivotable with respect to a vehicle by a boom cylinder and material handling unit pivotable with respect to the boom by a unit cylinder when the control of a boom control valve and a unit control valve. The control system includes a flow divider/combiner valve and operative in a boom-raise, unit-leveling mode to pass a preset portion of the fluid displaced from the rod end of the boom cylinder to the base end of the unit cylinder. The flow divider-combiner valve is operative in a boom-lower, unit-leveling mode, to combine the fluid stream displaced from the base end unit cylinder in a preset ratio with pressurized fluid, and pass the combined stream to the rod end of the boom cylinder. The control system can be disengaged from the automatic leveling mode to enable the boom unit to be operated manually under the control of the boom and unit control valves.

24 Claims, 4 Drawing Sheets

16
16b
16a
19
19b
19a
M
3
4
38
38b
45
7
8
58a
38a
58
58b
38d
38c
46
55
55a
56
56a
52
51
1
2
5
6
25f
25
25e
25d
35
36
26f
26c
50
25c
36a
35a
26d
25b
25a
R
26b
26
26a 16
16b
16a
19
19b
19a
M
3
4
38
38b
45
7
8
58a
38a
58
58b
38d
38c
46
55
55a
56
56a
52
51
1
2
5
6
25f
25
25d
35
36
26f
26c
50
25c
36a
35a
26d
R
25a
26b
26
25b
26a 16
16b
16a
19
19b
19a
M
3
4
38
38b
38a
38d
38c
45
46
7
8
58a
58
58b
55a
55
56
56a
52
51
1
25f
2
5
6
25e
25d
25
25c
25b
25a
35
36
36a
35a
R
26f
26c
50
26d
26
26a
26b 16
16b
16a
19
19b
19a
M
3
4
38
38b
38a
38d
38c
45
46
7
8
58
58b
55a
55
56
56a
52
51
1
25f
2
5
6
25e
25d
25
25c
25b
25a
R
35
36
36a
35a
26f
26c
50
26d
26b
26a
26

HYDRAULIC LEVELING CONTROL SYSTEM FOR A LOADER TYPE VEHICLE

BACKGROUND OF THE INVENTION

The present invention relates to a hydraulic levelling control system for a loader type vehicle and particularly to an improved hydraulic system for controlling the attitude of a material handling unit supported on a boom, during raising and during lowering of the boom.

Loader type vehicles generally include a boom pivotally carried on the vehicle with a material handling unit pivoted on the free end of the boom. Generally, the boom is raised and lowered on the vehicle by a boom cylinder having fluid supplied thereto through a boom control valve while the material handling unit is pivoted on the end of the boom through a unit cylinder having fluid supplied thereto through a unit valve. Fluid is generally supplied to the respective control valves from a reservoir through a pump.

In the absence of any self-leveling function, it is necessary for the operator of the loader type vehicle to operate both the boom valve and the unit valve one with each hand or foot, to maintain the material handling unit level while raising or lowering the boom. This operation is not only difficult but also requires the strict attention of the operator.

Hydraulic leveling systems have heretofore been made such as disclosed in U.S. Pat. No. 3,563,137, in which fluid exiting from the rod end of the boom cylinder during raising of the boom, is passed through a valve type flow divider that directs one portion of the inlet flow to the piston end of the unit cylinder while dumping a remaining portion of the inlet flow to drain, to level the unit during raising of the boom. This patent also discloses an embodiment in which the boom control valve was modified to provide a boom-raise, unit-leveling position and a boom-lower, unit-leveling position, in addition to the customary boom-raise and boom-lower positions. In that embodiment, the boom control valve was operative to pass fluid existing from the piston end of the boom cylinder during lowering of the boom through a second flow divider valve arranged to direct one portion of the flow to the rod end of the unit cylinder and to dump the remaining portion to drain. Valve type flow dividers divide flow from an inlet into separate streams at two outlets to in accordance with the pressure drop through two orifices and can operate reliably only when the pressure at the inlet is substantially greater than the pressure at either outlet. During lowering of the boom, a portion of the fluid from the piston end of the boom cylinder is passed to the rod end of the bucket cylinder. The area of the piston end of the boom cylinder is usually very large as compared to the area of the rod end of the unit cylinder and, under some operating conditions, the pressure at the piston end of the boom cylinder is too low as compared to the pressure required at the rod end of the bucket cylinder, to reliably move the bucket when the latter is loaded.

U.S. Pat. No. 5,447,094 discloses a leveling circuit using a valve type flow divider for controlling leveling of the bucket during raising of the boom and a motor type flow divider for controlling leveling of the bucket during lower of the boom. While this hydraulic leveling system operates during both raising and lowering of the boom, the motor type flow divider significantly increases the cost of the leveling system. Further, motor type flow dividers divide fluid in a fixed ratio and are not adjustable to change the fixed ratio to accommodate different size boom and unit cylinders such as are used in different loader-type vehicles.

SUMMARY OF THE INVENTION

It is an object of the present invention to provide an hydraulic control system for controlling the orientation of the material handling unit on a boom, and which is operative in an automatic leveling mode to reliably control leveling of the unit during both raising and lowering of the boom.

Another object of this invention is to provide an hydraulic control system in accordance with the foregoing object, and which will automatically disengage from the automatic leveling mode when the unit valve is operated to tilt the unit.

Another object of this invention is to provide an hydraulic control system for controlling the orientation of material handling unit supported on a boom in accordance with the foregoing object, and which will automatically disengage from the unit leveling mode and allow the boom to continue at the same speed, during either raising or lowering of the boom, when the unit cylinder bottoms out in either direction.

Another object of this invention is to provide an hydraulic control system in accordance with the forgoing object, and which is adjustable to enable use of the system on different material handling equipment having boom and unit cylinders with different displacement ratios.

In the present invention, an hydraulic control system is provided which is operable in an automatic leveling mode, to control leveling of a material handling unit mounted on the free end of a boom during both raising and lowering of the boom, using a proportional flow divider/combiner valve having a primary inlet and a first and second secondary outlets. In the automatic leveling mode, when the boom control valve is moved to a boom raise position, fluid from the fluid pressure inlet of the boom control valve is supplied to the boom-raise chamber and fluid from the boom-lower chamber of the boom cylinder is passed to the primary inlet of the flow divider/combiner valve which divides the flow into a first stream that is passed to the tilt-down chamber of the unit cylinder and a second stream which is returned to the reservoir through the boom control valve, to level the unit during raising the boom. When the boom control valve is moved to a boom-lower position, hydraulic fluid from the fluid pressure inlet of the boom control valve is supplied to the tilt-up chamber of the unit cylinder and to the second secondary passage of the flow divider/combiner valve, and fluid from the tilt-down chamber of the unit cylinder is passed to the first secondary passage of the flow divider/combiner valve. The streams from the first and second secondary passages are combined in a preset ratio in the flow divider/combiner valve and supplied to the boom-lower chamber of the boom cylinder, to maintain the unit in a preset attitude with respect to the ground, during lowering of the boom.

The control system includes valve means operable to change the operation from an automatic leveling mode to a manual mode and enable raising and lowering of the boom and tilting of the unit upwardly and downwardly independently of each other, under the control of the respective boom and unit control valves.

DETAILED DESCRIPTION

Figure 1:
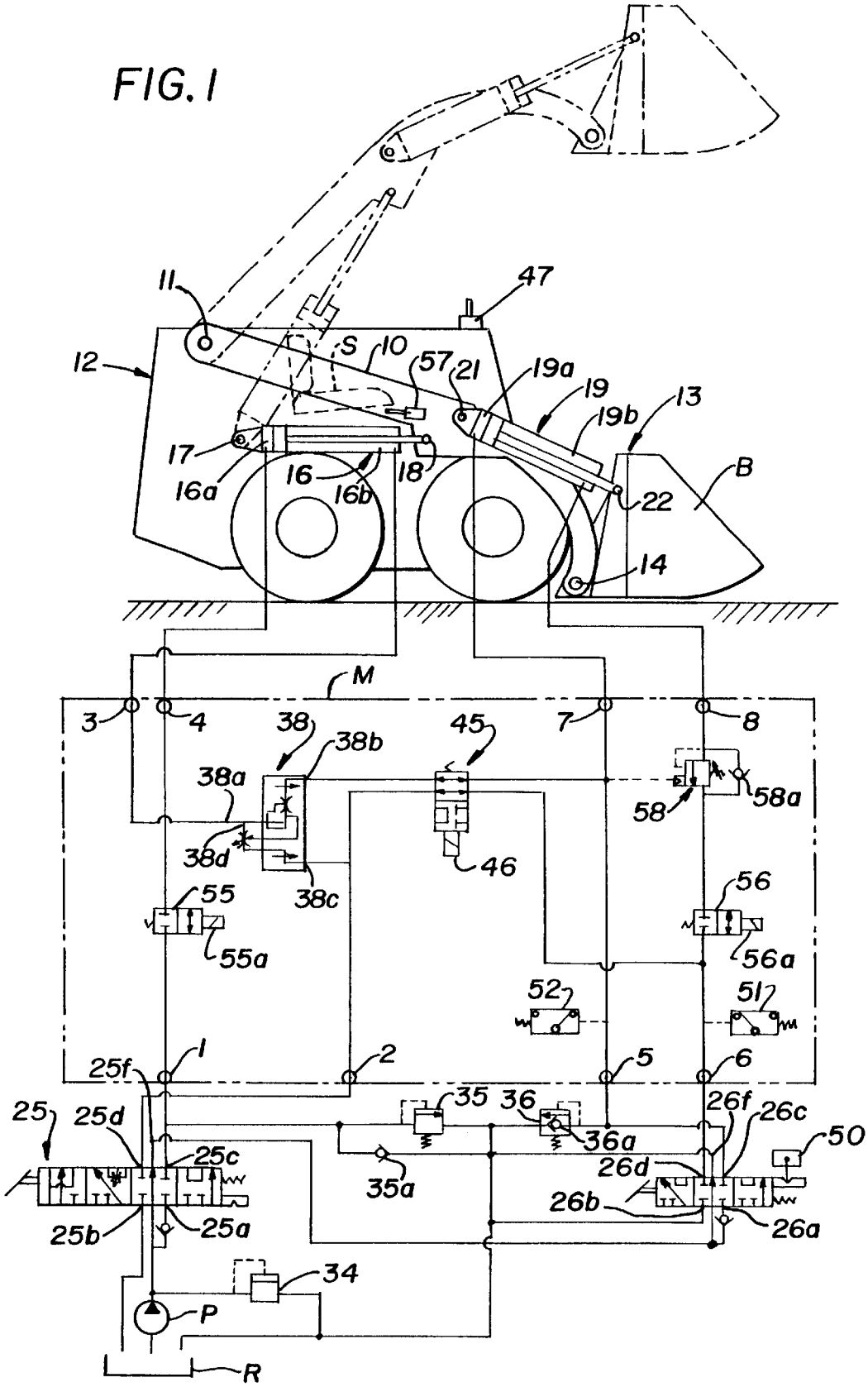
FIG. 1 is a schematic diagram illustrating an hydraulic control system for controlling a boom and a material handling unit supported on the boom, in a loader type vehicle, with the boom control valve and the unit valve shown in a neutral position.

The hydraulic control system of the present invention is generally adapted for use on material handling equipment such as end loaders and fork lifts that have a boom 10 pivoted as indicated at 11 on a vehicle 12, and a material handling unit 13 pivoted as indicated at 14 on the free end of the boom. The material handling unit 13 may for example, include a bucket as shown at B in FIG. 1, or a fork as shown at F in FIG. 7. The boom is raised and lowered relative to the vehicle by one or more double acting cylinder and piston assemblies 16 having the cylinder and pivoted at 17 to the vehicle and the rod end pivotally connected at 18 to the boom. The material handling unit 13 is tilted about the pivot 14 relative to the boom by a one or more double acting cylinder and piston assemblies 19, with the cylinder end pivotally connected at 21 to the boom and the rod end pivotally connected as indicated at 22 to the material handling unit 13. For convenience the term boom cylinder is hereinafter used to refer to one or more hydraulic cylinder and piston assemblies used to raise and lower the boom, and the term unit cylinder is used to refer to one or more cylinder and piston assemblies used to tilt and unit relative to the boom.

A boom control valve 25 is provided for reversibly supplying fluid under pressure to the boom cylinder 16, and a unit control valve 26 is provided for reversibly supplying fluid to the unit cylinder 19. The boom control valve 25 and unit control valve 26 are preferably of the open center series directional control valves as schematically illustrated in drawings. The boom control valve 25 has a fluid pressure inlet 25*a* and a fluid outlet 25*b*, a first control port 25*c* and a second control port 25*d*. The unit control valve 26 has a fluid pressure inlet 26*a* and a fluid outlet 26*b* and a first control port 26*c* and a second control pot 26*d*. The control valves 25 and 26 schematically illustrated are of the open center type and in the neutral position of the valves shown in FIG. 1 in which the boom is neither being raised or lowered, fluid under pressure from a pump P is passed through fluid outlet 25*f* in the boom control valve 25 to the unit control valve 26 and returned from the unit control valve through a fluid outlet 26*f* to a hydraulic fluid reservoir R.

Boom control valve 25 has at least a second or boom-raise position and a third or boom-lower position and preferably is of the four position type having a fourth or float position. The unit control valve 26 is preferably of the three position type having a second or tilt-down position and a third or tilt-up position. In the embodiment illustrated, valves 25 and 26 are arranged to be manually operated type by levers.

For reasons described more fully hereinafter, a first or primary pressure regulating valve 34 is connected to the outlet end of the pump to control the pressure at a preselected system pressure. A second pressure regulating 35 is connected to the first control outlet 25*c* of the boom control valve 25, and a third pressure regulating valve 36 is connected to the control outlet 26*c* of the unit control valve.

The unit leveling circuit includes a proportional flow divider/combiner valve 38 having a primary passage 38*a* and a first secondary passage 38*b* and a second secondary passage 38*c*. Flow divider/combiner valves are configured for use alternatively as a flow divider to divider a single inlet stream of hydraulic fluid entering the primary passage 38*a* in a preset ratio into two separate branch outlet streams that exit from the first and second secondary passages 38*b* and 38*c* at flow rates that are kept proportional to one another at various inlet flow rates and, reversely as a flow combiner, for keeping proportional to one another and combining, two separate inlet streams entering the first and second secondary passages 38*b* and 38*c* in said preset ratio into a single outlet stream exiting from the primary passage 38*a*. The ratio of flow dividing and combining is controlled by two orifices, each communicating with the primary passage and with a respective one of secondary passages. Flow dividers are commonly made with fixed orifices to provide a fixed ratio, for example 50/50, and a different ratio can be provided by making the two fixed orifices relatively different size. The flow divider/combiner valve is preferably configured so that the ratio of flow dividing and combining is adjustable from externally of the valve. This can be effected by providing an orifice between the primary passage and one of the secondary passages that is adjustable from externally of the valve housing. The externally adjustable orifice can be provided in lieu of one fixed orifice as indicated at 38*d* in FIG. 1, or by an externally adjustable orifice between the primary passage and a secondary passage, hydraulically parallel to one of the fixed orifices in the valve, as schematically indicated at 138*d* in FIG. 7.

When the boom control valve 25 is in its neutral position shown in FIG. 1, it blocks flow from the pressure supply passage 25*a* to the first control outlet 25*c* and also blocks return flow from the control outlet 25*d* to the fluid outlet 25*b*. Similarly, when the unit control valve is in its neutral position shown in FIGS. 1–3, it blocks flow from the pressure supply inlet 26*a* to the first control outlet 26*c* and also blocks return flow from the control outlet 26*d* to the fluid outlet 26*b*.

Figure 2:
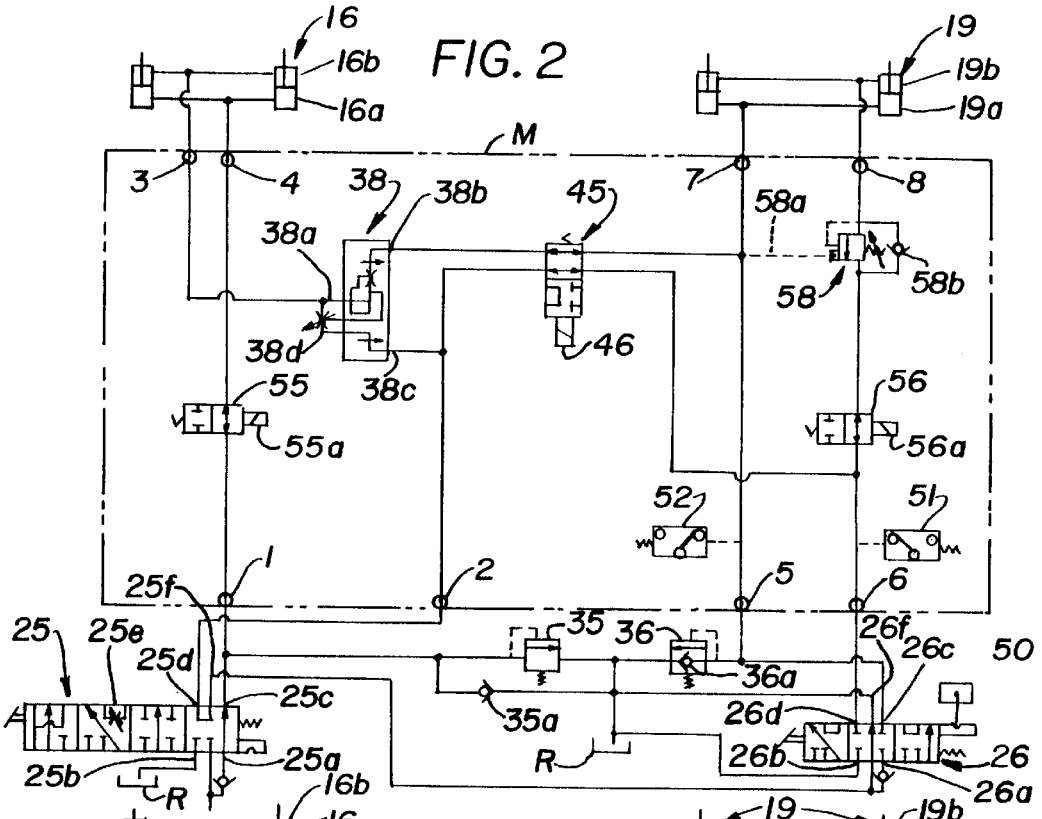
FIG. 2 is a schematic diagram of the hydraulic control system of FIG. 1 illustrating the system in a boom-raise, unit-leveling mode.

The control system is operable in a boom-raise, unit-leveling mode with the unit control valve 26 in its neutral position and the boom control valve 25 moved from the neutral position to a boom-raise position as schematically shown in FIG. 2, to maintain the unit in a preset orientation with respect with a reference plane such as the ground, as the boom is raised. In the boom-raise, unit-leveling mode, the control system provides passage means for passing hydraulic fluid from the fluid pressure inlet 25*a* of the boom control valve 25 to the boom-raise chamber 16*a* of the boom cylinder 16, and for passing hydraulic fluid from the boom-lower chamber 16*b* to the primary passage 38*a* of the flow divider/combiner valve 38. The flow divider/combiner valve divides the inlet stream from the primary passage 38*a* into first and second outlet streams at the first and second secondary passages 38*b* and 38*c* respectively. In the boom-raise, unit-leveling mode as shown in FIG. 2, the control system also provides passage means for passing the first outlet stream exiting from the first secondary outlet passage 38*b* of the flow divider/combiner valve to the tilt-down chamber 19*a* in the unit cylinder 19, to tilt the unit downwardly as the boom is raised. As shown in FIG. 2, the control system also provides passages for passing fluid from the tilt-up chamber 19*b* of the unit cylinder 19 and from the second secondary passage 38*c* of the flow divider/combiner valve, to the second control passage 25*d* of the boom control valve for return to the reservoir R. Thus, a preset portion of the fluid displaced from the boom-lower chamber 16*b* of the boom cylinder during raising the boom, is passed from the flow divider/combiner valve to the tilt-down chamber 19*a* of the unit cylinder, to maintain the unit in a preset orientation relative to the ground during raising the boom.

Figure 3:
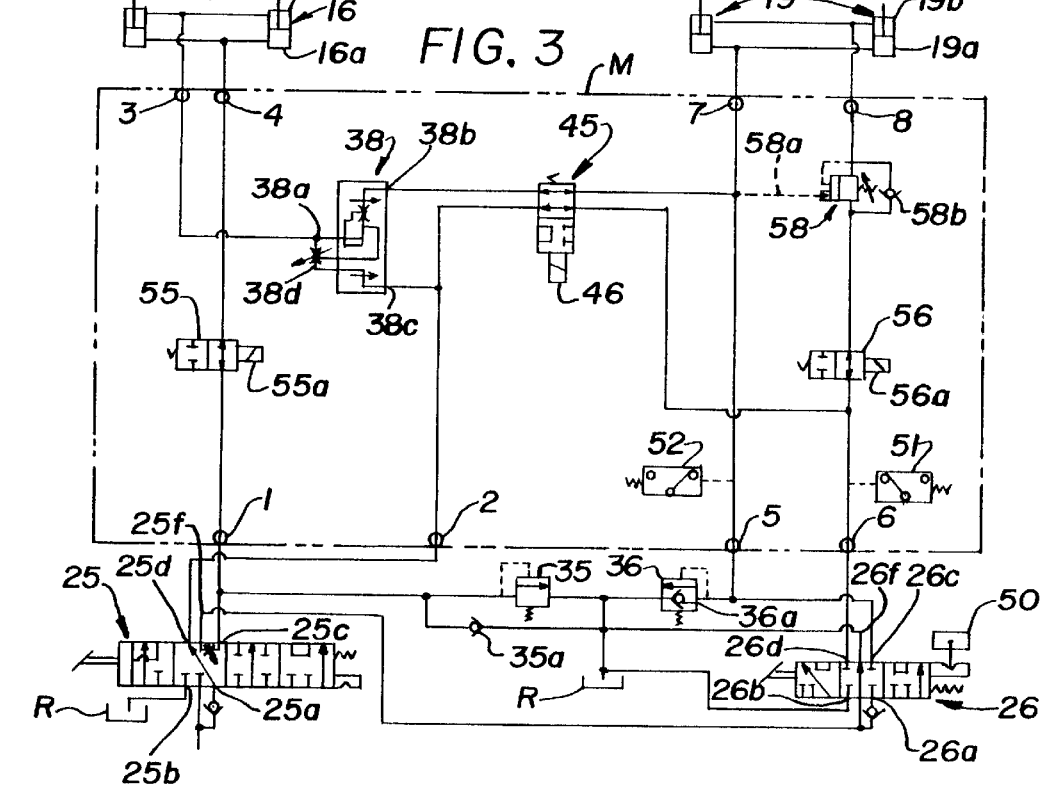
FIG. 3 is a schematic diagram of the control system of FIG. 1 illustrating the system in a boom lower unit-leveling mode.

The control system is also arranged for operation in a boom-lower, unit-leveling mode with the unit control valve in its neutral position, when the boom control valve is moved from the neutral position to a boom-lower position, shown in FIG. 3, to maintain the unit 13 in a preset orientation with respect to a reference plane such as the ground, as the boom is lowered. In the boom-lower, unit-leveling mode shown in FIG. 3, the control system forms an hydraulic circuit configured to provide passages for passing hydraulic fluid from the fluid pressure inlet 25*a* of the boom control valve 25 to the tilt-up chamber 19*b* of the unit cylinder 19 and to the second secondary passage 38*c* of the flow divider/combiner valve 38, and passages for passing fluid from the tilt-down chamber 19*a* to the first secondary passage 38*b* of the flow divider/combiner valve 38. In the boom-lower, unit-leveling mode, the flow divider/combiner valve operates to combine the two separate inlet streams from secondary passages 38*b* and 38*c* in the preset ratio into a combined outlet stream at the primary passage 38*a,* and as shown in FIG. 3, the combined outlet stream from primary passage 38*a* is passed through passages to the boom-lower chamber 16*b* of the boom cylinder 16, and fluid from the boom-raise chamber 16*a* is passed through passages to the first control outlet 25*c* of the boom control valve and returned to the fluid reservoir R.

Thus in the boom-lower, unit leveling mode, fluid pressure is supplied from the boom control valve 25 to the tilt-up chamber 19*b* of the unit cylinder and fluid displaced from the tilt-down chamber 19*a* of the unit cylinder is combined in a preset ratio with pressurized fluid in the flow divider-combiner valve and the combined stream passed to boom-lower chamber 16*b* of the boom cylinder. Fluid from the boom-raise chamber 16*a* of the boom cylinder is returned through the boom control valve to the reservoir.

In order to assure that automatic leveling of the unit begins soon as the boom starts to move down, fluid pressure should be generated in the tilt-up chamber of the unit cylinder sufficient to move the unit under the maximum load carried by the unit, before the boom starts to move down. The boom and the unit and load carried by the unit is supported by the fluid pressure in the boom-raise chamber of the boom cylinder and the control system includes means arranged to supply fluid pressure to the tilt-up chamber of the unit cylinder prior to opening the boom-raise chamber 16*a* of the boom cylinder 16 to the reservoir.

The embodiment of FIGS. 1–6, the boom control valve is configured such that the control valve opens to supply fluid pressure to the tilt-up chamber of the tilt cylinder, before it opens to pass fluid from the boom-raise chamber of the boom cylinder to the reservoir, when the boom control valve is moved from the neutral to the boom-lower position. The boom control valve 25 is of the type having a meter-out spool system as schematically indicated at 25*e,* which is configured to provide a progressive change in the volume of flow from the first control port 25*c* to the reservoir, as the spool is moved from the neutral position to the boom-lower position.

Figure 4:
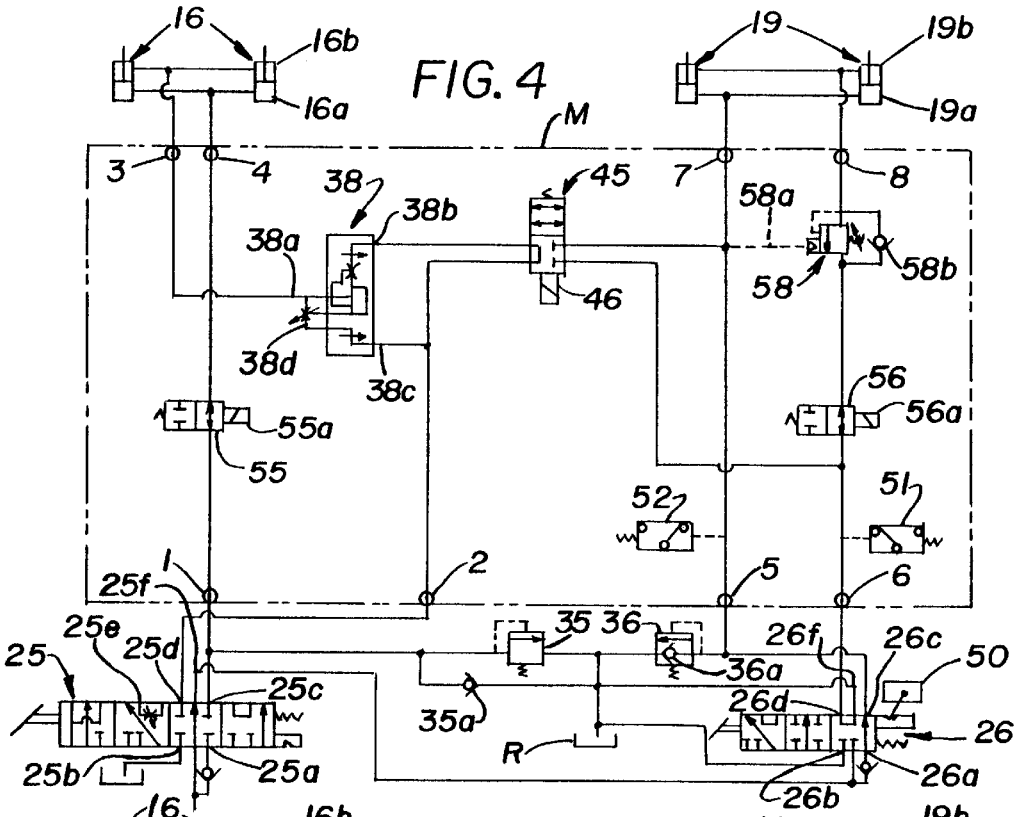
FIG. 4 is a schematic diagram of the control system of FIG. 1 illustrating the control system in a manual mode with the unit control valve in a position to tilt the unit downwardly.
Figure 5:
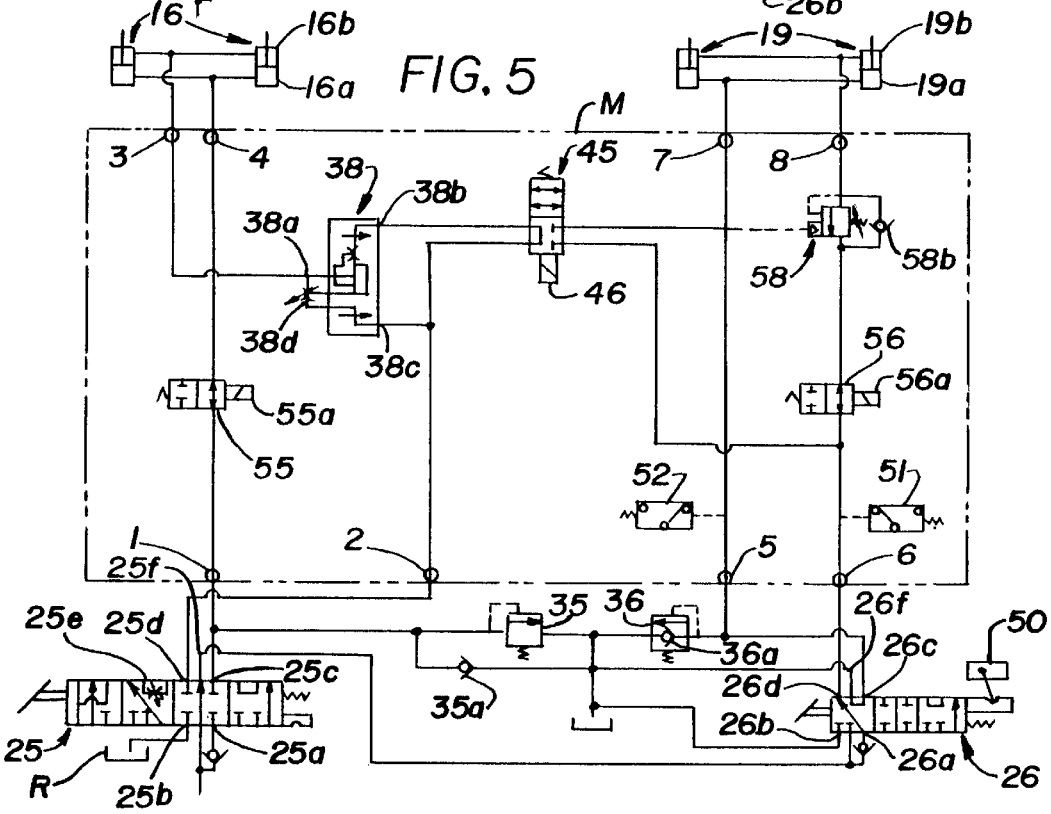
FIG. 5 is a schematic diagram of the control system of FIG. 1 in a manual mode with the unit control valve in a position to tilt the unit upwardly.
Figure 6:
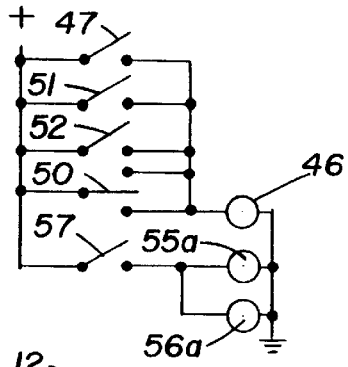
FIG. 6 is a schematic diagram of an electric circuit for actuating the electro-responsive valves used in the control system.

The control system includes valve means for disengaging the unit from the automatic leveling mode to enable raising and lowering of the boom and tilting of the unit downwardly and upwardly manually under the control of the boom control valve 25 and unit control valve 26. In the embodiment of FIGS. 1–6, the control system includes a four-way two-position disengagement valve 45 which is movable between an open position as shown in FIGS. 1–3, to a closed position as shown in FIGS. 4 and 5 in which it blocks flow from the tilt-down chamber 19*a* of the unit cylinder to the first secondary passage 38*b* of the flow divider/combiner valve; blocks flow from the tilt-up chamber 19*b* of the unit cylinder 19 to the second secondary passage of the flow divider/combiner valve, and communicates the first secondary passage with the second secondary passage of the flow divider/combiner valve. Valve 45 is moved by a spring to one position and by an actuator to the other position. The valve 45 shown herein is spring biased open and moved by a solenoid actuator 46 from its normally open position shown in FIGS. 1–3 to its closed position shown in FIGS. 4 and 5. A manually operable switch diagrammatically indicated at 47 in FIG. 1 and schematically illustrated in FIG. 6, is provided to enable selective operation of the valve 45 to its leveling disengagement position, for manual control of raising and lowering of the boom and tilting of the unit under the control of boom valve 25 and tilt valve 26. Provision is also made for automatic operation of valve 45 to its leveling disengagement position. A switch 50 is arranged for actuation by the unit control valve 26 to disengage automatic leveling when the unit control valve is moved from its neutral position to either its tilt-up or tilt-down positions. As diagrammatically illustrated in FIGS. 1–5, a first pressure responsive switch 51 is arranged for actuation from a normally open to a closed position, when the pressure in the tilt-up chamber 19*b* of the unit tilt cylinder 19 exceeds a preset value substantially below system pressure, and a second pressure responsive switch 52 is provided and arranged for actuation to a closed position when the pressure in the tilt-down chamber 19*a* of the unit cylinder 19 exceeds a preset value substantially below system pressure, to disengage automatic leveling when the pressure reaches the preset value. Thus, the automatic leveling disengagement valve 45 is actuated to disengage automatic leveling in response to either manual operation of switch 47 or by closing the switch 50 in response to operation of the unit control valve 25 from its neutral position to either the tilt-up or the tilt-down positions, or by pressure responsive switches 51 and 52. Pressure switches 51 and 52 will also be actuated to disengage automatic leveling when the unit cylinder bottoms out at either end of its stroke. Accordingly, when the unit cylinder bottoms out, the boom cylinder can continue either raising or lowering the boom at the same speed as before the unit cylinder bottomed out. If the boom control valve is operated to continue movement of the boom cylinder after the unit cylinder bottoms out and until the boom cylinder reaches a bottom out position, then the boom and unit cylinders will bottom out at the same time in the next operation.

When the valve 45 is in the leveling disengagement position shown in FIGS. 4 and 5, the control system is operable in a manual mode to provide passages connecting the control outlet 26*c* of the unit control valve 26 to the tilt-down chamber 19*a* and passages connecting the control outlet 26*d* to the tilt-up chamber of the unit cylinder 19, so that the tilt cylinder can be operated to tilt the unit up or down. In the manual mode, the control system also provides passages connecting the control outlet 25*c* of the boom control valve to the boom-raise chamber 16*a,* and passages that connect the control outlet 25*d* to the second secondary passages 38*c* and through the valve 45 to the first secondary passage 38*b* of the flow divider/combiner valve 38; and passages that connect the primary passage of the flow divider/combiner valve 38 to the boom-lower chamber 16*b* of the boom cylinder. Thus, when the boom control valve is moved to the boom-raise position, pressurized fluid is passed from control port 25*c* to the boom-raise chamber 16*a,* and fluid from the boom-lower chamber 16*b* is passed through the flow divider/combiner valve 38 and valve 38 and valve 45 to the control outlet 25*d* of the boom control valve for return to the reservoir. When the boom control valve is moved to the boom-lower position, pressurized fluid is passed from control outlet 25*d* through valve 45 and flow divider/combiner valve 38 to the boom-lower chamber 16*b,* and fluid from the boom-raise chamber 16*a* is passed to the control outlet 25*c,* and returned to the reservoir, to allow the boom to move down.

The pressure relief valves 35 and 36 are provided to enable the boom and bucket to be operated under control of boom valve 25 and bucket valve 26, to press the bucket down into the ground with sufficient force to raise the wheels on the forward end of the vehicle off the ground. Pressure relief valve 36 is set to relieve when the pressure at the base end of the unit cylinder exceeds a preselected value several hundred psi above the setting of the main relief valve 34 and relief valve 35 is set to relieve when the pressure in the base end of the boom cylinder reaches a preset value several hundred psi lower than the setting of the main relief valve 34. Check valve 35*a* is arranged to open for flow from the reservoir to the boom-lower chamber 16*b* of the boom cylinder to prevent cavitation during lowering the boom under heavy load, and check valve 36*a* is arranged to open for flow from the reservoir to the tilt-down chamber of the unit cylinder, to prevent cavitation during tilting the unit downwardly under heavy load.

Safety lock valves 55 and 56 are provided for preventing operation of the boom and unit cylinders, if an operator is not in proper operating position on the vehicle. Safety valve 55 is provided in the passage between the control outlet port 25*c* of the boom control valve and the boom-raise chamber 16*a* of the boom cylinder, and safety valve 56 is provided in the passage between the control outlet port 26*d* of the unit control valve and the tilt-up chamber 19*b* of the unit cylinder. These valves are of the two-position normally closed type and are operated by solenoids 55*a* and 56*a* respectively to an open position in response to closing of a safety switch 57 arranged to be actuated when the operator is in proper operating position on the vehicle. For example, is diagrammatically shown in FIG. 1, the switch 57 may be positioned to be actuated by the seat S of the vehicle, when the seat is occupied. As schematically illustrated in FIG. 6, switch 57 controls energization of solenoids 55*a* and 56*a* so that the valves 55 and 56 are actuated to their open positions whenever the vehicle operator is in proper position in the vehicle.

A counterbalance valve 58 is provided in the passage between the control port 26*d* of the unit control valve and the tilt-up chamber 19*b* of the unit cylinder 19, to restrict flow from the tilt-up chamber and prevent uncontrolled downward tilting of the unit by gravity. The counterbalance valve is pilot operated as indicated by pilot line 58*a* in response to pressure in the tilt-down chamber 19*a* of the unit cylinder, to release pressure in the tilt-up chamber at a preselected rate when the pressure in the tilt-down chamber reaches a preset value below system pressure. A check valve 58*b* to provided for bypassing the counterbalance valve to permit substantially unrestricted flow to the tilt-up chamber of the unit cylinder.

The flow divider valve 38, level disengaging valve 45, safety valves 55 and 56 and the counterbalance valve 58 are conveniently mounted in a manifold schematically indicated by a broken outline designated M. Pressure switches 51 and 52 are also conveniently mounted on the manifold at locations arranged to communicate with the appropriate passages in the manifold. The manifold has fittings 1 and 2 adapted for connection through hoses or lines to the boom valve 25 and fittings 3 and 4 adapted for connection through hoses or lines to the boom cylinder 16. Manifold also has fittings 5 and 6 adapted for connection through hoses or lines to the tilt valve and fittings 7 and 8 adapted for connection through hoses and lines to the unit cylinder.

Figure 7:
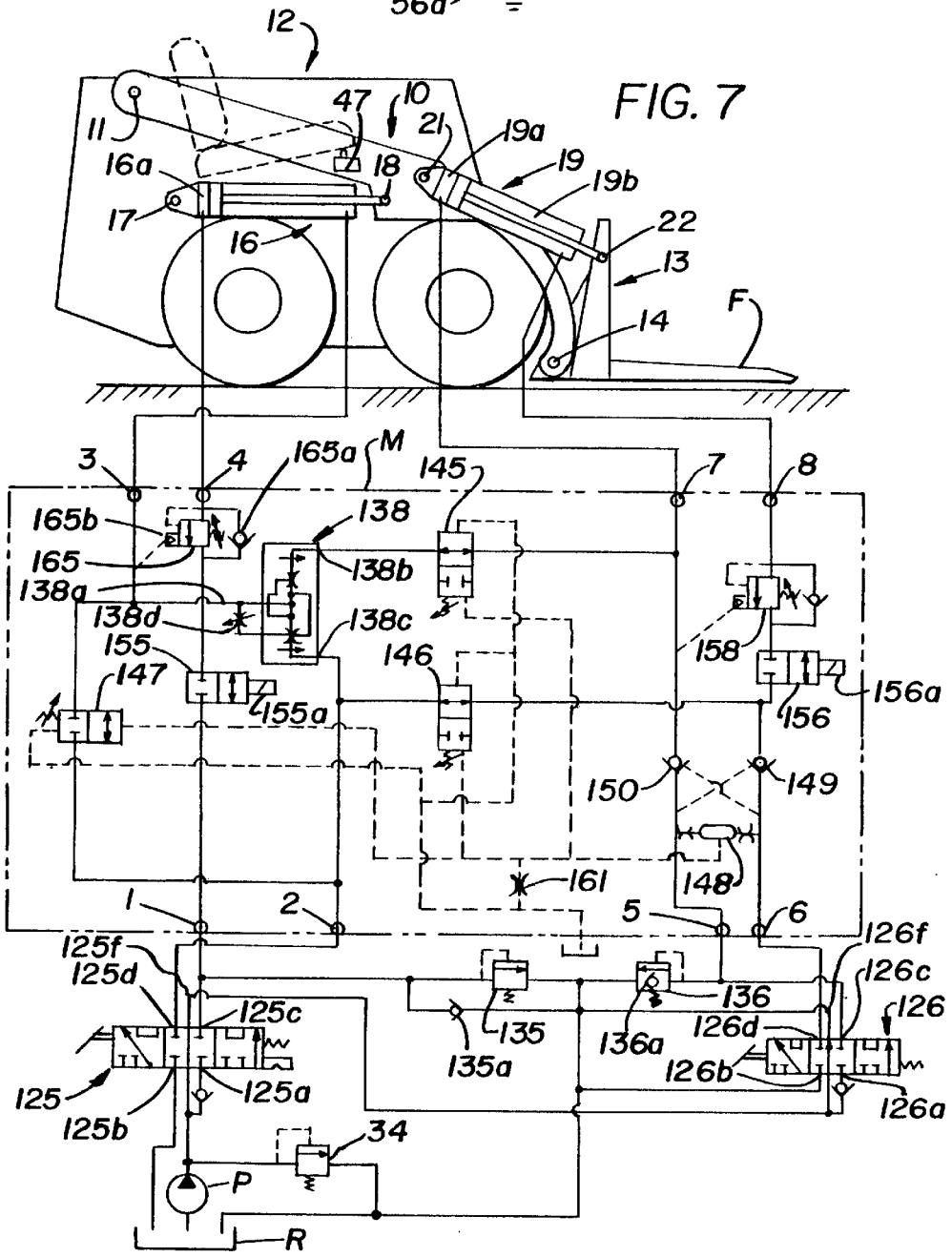
FIG. 7 is a schematic diagram illustrating a modified hydraulic control system for controlling leveling of the unit during raising and lowering of the boom.

A second embodiment of the invention is schematically shown in FIG. 7 and like numerals are used to designate the same parts, and like numerals in the 100 series to designate corresponding parts of the control system. In the embodiment of FIGS. 1–6 the material handling unit 13 is illustrated as a bucket designated B. In the embodiment of FIG. 7, the material handling unit 13 is illustrated as a fork lift designated F. As described in the preceding embodiment, a boom control valve 125 is provided for reversibly supplying hydraulic fluid under pressure to the boom cylinder 16 and a unit control valve 126 is provided for supplying fluid under pressure to the unit cylinder 19. Valve 125 is a three-position valve having a fluid pressure inlet 125*a* and a return outlet 125*b,* a first control port 125*c* and a second control port 125*d* and a fluid outlet 125*f.* Unit tilt valve 126 is of the three position valve type having a fluid pressure inlet 126*a,* return outlet 126*b* and first and second control ports 126*c* and 126*d* respectively and a fluid outlet 126*f.* Fluid pressure from pump P is regulated by a primary pressure regulating valve 34 and is supplied to the fluid pressure inlets 125*a* and 126*a* of valves 125 and 126. The bucket leveling circuit includes a flow divider/combiner valve 138 having a primary passage 138*a* and a first secondary passage 138*b* and a second secondary passage 138*c*. The flow divider/combiner valve is configured to divide a single inlet stream entering the primary passage 138*a* in a preset ratio into two separate outlet streams exiting from the first and second secondary passages 138*b* and 138*c* and, reversely, to combine two separate inlet streams entering the first and second secondary passages 138*b* and 138*c* in said preset ratio into a single outlet stream exiting from the primary passage 138*a.* The flow divider/combiner valve 138 preferably has an adjustable orifice 138*d* connected between the primary passage 13*a* and one of the second secondary passages 138*c,* to enable adjustment of the preset flow divider/combiner ratio. When the boom control valve 125 is in its neutral position shown in FIG. 7, it blocks flow from the pressure supply passage to the first control port 125*c* and also blocks return flow from the control port 125*d* to the return passage 125*b.* Similarly, when the unit control valve is in its neutral position shown in FIG. 7, it blocks flow from the pressure supply inlet 126*a* to the first control port 126*c* and also blocks return flow from the second control port 126*d* to the return passage 126*b.*

The control system is operable in a boom-raise, unit-levelling mode with the unit control valve 26 in its neutral position and the boom control valve 25 in its boom-raise position, that is with the boom control valve shifted to the left as viewed in FIG. 7, to maintain the unit in a preset orientation with respect to a reference plane such as the ground, as the boom is raised. In the boom-raise, unit-leveling node, the control system is configured to provide passages for passing hydraulic fluid from the fluid pressure inlet 125*a* to the boom-raise chamber 16*a* of the boom cylinder 16, and for passing hydraulic fluid from the boom-lower chamber 16*b* of the boom cylinder 16 to the primary passage 138*a* of the flow divider/combiner valve 138. The flow divider/combiner valve divides the inlet stream from the primary passage 138*a* into first and second secondary streams at passages 138*b* and 138*c* respectively. In the boom-raise, unit-leveling mode, the control system also provides passages for passing the outlet stream exiting from the first secondary outlet passage 138*b* of the flow divider/combiner valve to the tilt-down chamber 19*a* of the unit cylinder 19 and to pass the outlet stream from the second secondary passage 138*c* to the second control passage 125*d* of the boom control valve 125 for passage back to the reservoir R.

The control system is also arranged for operation in a boom-lower, unit-leveling mode, with the unit control valve 126 in the neutral position shown in FIG. 7, and with the boom control valve shifted to the right as viewed in FIG. 7, to a third or boom-lower position, to maintain the unit 13 in a preset orientation with respect to a reference plane such as the ground, as the boom is lowered. In the boom-lower, unit-leveling mode, the control system forms a hydraulic circuit configured to provide passage means for passing fluid from the fluid pressure inlet 125*a* of the boom control valve 125 to the second secondary passage 138*c* of the flow divider-combiner valve and to the tilt-up chamber 19*b* of the unit cylinder 19. In the boom-lower unit-leveling mode, the hydraulic circuit also provides passage means for passing fluid from the tilt-down chamber 19*a* of the unit cylinder to the first secondary passage 138*b* of the flow divider/combiner valve 138 and the flow divider/combiner valve combines the two separate inlet streams from secondary passages 138*b* and 138*c* in the preset ratio into a single or combined outlet stream at the primary passage 138*a*. The combined outlet stream from the primary port of the flow divider/combiner valve 138 is passed through a passage to the boom-lower chamber 16*b* of the boom cylinder 16. Fluid from the boom-raise chamber 16*a* is returned to the reservoir R through the passage that communicates with the port 125*b* in the boom control valve.

As discussed in connection with the embodiment of FIGS. 1–6, to assure that automatic leveling of the unit begins when the boom starts to move down in the boom-lower, unit leveling mode, fluid pressure should be generated in the tilt-up chamber 19*b* of the unit cylinder 19 sufficient to move the unit under the maximum load carried by the unit, before the boom starts to move down. In the embodiment of FIG. 7 the control system includes a load holding valve 165 which cooperates with the boom control valve 125, to assure supply of the fluid pressure to the tilt-up chamber of the unit cylinder, prior to opening of the boom-raise chamber of 16*a* of the boom cylinder to reservoir R. The load holding valve 165 is arranged in the passage between the boom-raise chamber 16*a* and the boom control valve 125 and is normally closed to hold the boom against downward movement and is pilot operated to an open condition to allow the boom to move down. A check valve 165*a* is arranged to by-pass the holding valve 165 and open for flow from the boom control valve to the boom-raise chamber 16*a*. A counterbalance valve is a type of load holding valve and the loading holding vlve symbol in FIG. 7 is that of a counterbalance valve. As is conventual, counterbalance valves are spring biased to a normally closed position to restrict flow and regulate pressure from the boom-raise chamber 16*a* and pilot operated to a flow condition. Valve 165 is conveniently pilot operated in response to fluid pressure conditions in boom-lower chamber 16*b*. In the boom-lower, unit leveling mode, fluid pressure in the boom-lower chamber 16*b* builds up after the control valve is moved to its boom-lower position and fluid pressure is generated in the tilt-up chamber sufficient to move the load carrying unit and apply sufficient pilot pressure to operate load holding valve 165 to an open position.

The counterbalance valve 165 will restrict the flow rate from the boom-raise chamber of the boom cylinder, to the flow rate from the flow divider to the boom-lower chamber 16*b* during lowering the boom in either the self-leveling mode or the manual mode. For example if the rate of downward movement of the piston in the boom cylinder would exceed the inflow rate from the flow divider/combiner valve 138 during the self-leveling mode, this would cause a pressure reduction in the boom-lower chamber and this pressure reduction would reflect to the pilot of the counterbalance valve and reduce flow from the boom-raise chamber.

With the load holding valve 165 in the control system to delay opening of the boom-raise chamber to drain, the boom control valve 125 can be a metering or not-metering type. As will be apparent to those skilled in the art, the load holding valve can be used in the embodiment of FIGS. 1–6, in the manner disclosed in FIG. 7.

The embodiment of FIG. 7 also includes means for disabling automatic leveling so that the control system can be operated in a manual mode. In the manual mode, the control system provides passages for connecting the boom control valve 125 to the boom cylinder 16 and the unit control valve 126 to the unit cylinder 19, to enable raising and lowering of the boom and tilting of the unit independently of each other under the control of boom control valve 125 and unit control valve 126. In this embodiment, a normally open two-way two-position valve 145 is arranged to be operated from a normally open position shown in FIG. 7 to a second position, to block flow between the tilt-down chamber 19*a* of the tilt cylinder and the first secondary passage 138*b* of the flow divider/combiner valve, and another two-way two-position valve 146 is arranged to be operated from a normally open position shown in FIG. 7 to a closed position blocking flow between the tilt-up chamber 19*b* of the tilt cylinder 19 and the second secondary passage 138*c* of the flow divider/combiner valve. A third two-way two-position valve 147 is arranged for movement between a normally closed position as shown in FIG. 7 to an open position, to provide a by-pass passage between the second control port 25*d* of the boom control valve and the boom-lower chamber 16*b* of the boom cylinder 16.

Valves 145 and 146 are spring biased to a normally open position and pilot operated to a closed position, and valve 147 is spring biased to a normally closed position and pilot operated to an open position, when unit control valve 126 is moved from its neutral position to either a tilt-up or tilt-down position. The spring ends of these valves are vented by passages to the reservoir and as shown in FIG. 7, and pilot pressure to valves 145, 146, and 147 is provided from a back-to-back check valve 148 having inlets connected to control outlet ports 126*c* and 126*d* of unit control valve 26. The pilot passages are vented to reservoir through a flow restrictor 161 to regulate pilot pressure. Pilot operated check valves 149 and 150 are provided to normally block flow through passages from tilt-up chamber 19*b* and from the tilt-down chamber 19*a* of the unit cylinder to the back-to-back check valve 148. When the unit control valve is moved to a tilt-down position, pressurized fluid is supplied from the pressure supply inlet 126*a* through the check valve 150 to the tilt-down chamber 19*a* and check valve 149 is pilot operated to an open position to allow flow from the tilt-up chamber 19*b* to the return outlet 126*b* of the unit control valve. When the unit control valve 126 is moved to the tilt-up position, fluid pressure is supplied from fluid pressure inlet 126*a* through check valve 149, to the tilt-up chamber 19*b*, and check valve 150 is pilot operated open to pass fluid from the tilt-down chamber 19*b* to the return outlet 126*b*.

As described in connection with the embodiment of FIGS. 1–6, safety valves 155 and 156 are provided for preventing operation of the boom and tilt cylinders, if an operator is not in proper position on the vehicle. Safety valve 155 is in a passage between the control outlet port 125*c* of the boom control valve and the boom-raise chamber 16*a* of the boom cylinder, and safety valve 156 is in a passage between the control outlet port 126*d* of the unit valve and the chamber 19*b* of the unit cylinder. The valves are of the two-position, normally closed type and are operated by solenoids 155*a* and 156*a*, respectively to an open position in response to closing of a safety switch 47. As diagrammatically illustrated in FIG. 7, switch 47 is positioned to be actuated by the seat S of the vehicle when the seat is occupied. Thus, safety valves 155 and 156 are actuated to an open position whenever the vehicle operator is in proper position in the vehicle.

A counterbalance valve 158 is provided in the passage between the tilt-up chamber 19*b* of the unit cylinder and the control port 126*d* of the unit control valve for a purpose previously described in connection with the embodiment of FIGS. 1–6. Relief valves 135 and 136 and check valves 135*a* and 136*a* are connected to control ports 126*c* and 125*c* respectively for the purpose previously described in connection with the embodiments of FIGS. 1–6.

The flow divider/valve 138, safety valves 145 and 146, by-pass valve 147, and emergency valve 158 are conveniently mounted in a manifold schematically indicated by broken outline designated M. The manifold has fittings designated 1 and 2 adapted for connection through hoses to the boom valve 125 and fittings 3 and 4 adapted for connection through hoses to the boom cylinder 19. The manifold also has fittings 5 and 6 adapted for connection through hoses or lines to the unit valve 126 and fittings 7 and 8 adapted for connection through hoses or lines to the unit cylinder 19.

While preferred embodiments of the invention have been described in specific detail for purposes of illustration, it will be understood that various modifications may be made in the described embodiments without departing from the spirit and scope of the invention as defined in the appended claims.

The embodiments of the invention in which an exclusive property or privilege is claimed are defined as follows:

What is claimed is:

1. A control system for a lift boom pivotable with respect to a frame by a boom cylinder and a material handling unit pivotable with respect to the boom by a unit cylinder, the boom cylinder having a boom-raise chamber and a boom lower chamber, the unit cylinder having a tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage and a first and second secondary passages and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder; and (iv) for passing hydraulic fluid from the boom-raise chamber of the boom cylinder to the fluid outlet of the boom control valve, to maintain the unit in a preset orientation with respect to a reference plane as the boom is lowered.

2. A control system according to claim 1 wherein the boom control valve is a meter-out type valve configured to progressively change fluid flow from the boom-raise chamber of the boom cylinder as the boom control valve is moved from the neutral to the boom-lower positions.

3. A control system for a lift boom pivotable with respect to a frame by a boom cylinder and a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder; and (iv) for passing hydraulic fluid from the boom-raise chamber of the boom cylinder to the fluid outlet of the boom control valve, (f) the flow divider/combiner valve including means for adjusting said preset ratio.

4. A hydraulic control system for raising and lowering a lift boom pivotable with respect to a frame by a boom cylinder and for controlling leveling of a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom direction-control valve having first and second boom control ports, the boom direction-control valve being selectively movable from a neutral position to a boom-raise position passing fluid from a pressurized source to the first boom control port, and to a boom-lower position passing fluid from the pressure source to the second boom control port, (b) a unit direction-control valve having first and second unit control ports, the unit direction-control valve being selectively movable from neutral position to a tilt-up position passing fluid from the pressure source to the first unit control port and to a tilt-down position passing fluid from the pressure source to the second unit control port, (c) a proportional flow divider/combiner valve having a primary passage and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit direction-control valve is in the neutral position and the boom direction-control valve is in the boom-raise position:

(i) for passing hydraulic fluid from the first boom control port to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the second boom control port, to maintain the unit in a preset orientation with respect to a reference plane as the boom is raised;

(e) the hydraulic circuit being configured to provide passage means when the unit direction-control valve is in the neutral position and the boom direction-control valve is in the boom-lower position:

(i) for passing fluid from the second boom control port to the tilt-up chamber of the unit cylinder and to second secondary passage of the flow divider/combiner valve;

(ii) for passing hydraulic fluid from the tilt-down chamber of the unit cylinder to the first secondary passage of the flow divider/combiner valve;

(iii) for passage hydraulic fluid from the primary passage of the flow divider/combiner valve to the boom-lower chamber of the boom cylinder, and (iv) for passing hydraulic fluid from the boom-raise chamber of the boom cylinder to the first boom control port to maintain the unit in a preset orientation with respect to a reference plane as the boom is lowered.

5. A control system for a lift boom pivotable with respect to a frame by a boom cylinder and a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage, and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder;

(iv) for passing hydraulic fluid from the boom-raise chamber of the boom cylinder to the fluid outlet of the boom control valve, to maintain the unit in a preset orientation with respect to a reference plane as the boom is lowered, (f) the hydraulic circuit being configured to provide passage means when the unit control valve is in the tilt-down position:

(i) for passing hydraulic fluid from the fluid pressure inlet in the unit control valve to the tilt-down chamber of the unit cylinder;

(ii) for passing hydraulic fluid from the tilt-up chamber of the unit cylinder to the fluid outlet of the unit control valve, to tilt the unit downwardly relative to the boom, (g) the hydraulic circuit being configured to provide passage means when the unit control valve is in the tilt-up position:

(i) for passing hydraulic fluid from the fluid pressure inlet of the unit control valve to the tilt-up chamber of the unit cylinder; and (ii) for passing hydraulic fluid from the tilt-down chamber of the unit cylinder to the fluid outlet of the unit control valve, to tilt the unit downwardly relative to the boom, (h) the flow divider/combiner valve including means for adjusting said preset ratio.

6. A control system according to claim 5 wherein the boom control valve has means operative to meter-out fluid flow from the boom-raise chamber of the boom cylinder as the boom control valve is moved from the neutral to the boom-lower position.

7. A control system for a lift boom pivotable with respect to a frame by a boom cylinder and a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage, and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder;

(iv) for passing hydraulic fluid from the boom-raise chamber of the boom cylinder to the fluid outlet of the boom control valve, to maintain the unit in a preset orientation with respect to a reference plane as the boom is lowered, (f) the hydraulic circuit being configured to provide passage means when the unit control valve is in the tilt-down position:

(i) for passing hydraulic fluid from the fluid pressure inlet in the unit control valve to the tilt-down chamber of the unit cylinder;

(ii) for passing hydraulic fluid from the tilt-up chamber of the unit cylinder to the fluid outlet of the unit control valve, to tilt the unit downwardly relative to the boom, (g) the hydraulic circuit being configured to provide passage means when the unit control valve is in the tilt-up position:

(i) for passing hydraulic fluid from the fluid pressure inlet of the unit control valve to the tilt-up chamber of the unit cylinder; and (ii) for passing hydraulic fluid from the tilt-down chamber of the unit cylinder to the fluid outlet of the unit control valve, to tilt the unit downwardly relative to the boom, (h) means operative when the unit control valve is moved from its neutral position to either tilt-up position or the tilt-down position:

(i) to block flow between the tilt-up chamber of the unit cylinder and the second secondary passage of the flow divider/combiner valve; and (ii) to block flow between the tilt-down chamber of the unit cylinder and the first secondary passage of the flow divider/combiner valve.

8. A control system for a lift boom pivotable with respect to a frame by a boom cylinder and a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage, and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder;

(iv) for passing hydraulic fluid from the boom-raise chamber of the boom cylinder to the fluid outlet of the boom control valve, to maintain the unit in a preset orientation with respect to a reference plane as the boom is lowered, (f) the hydraulic circuit being configured to provide passage means when the unit control valve is in the tilt-down position:

(i) for passing hydraulic fluid from the fluid pressure inlet in the unit control valve to the tilt-down chamber of the unit cylinder;

(ii) for passing hydraulic fluid from the tilt-up chamber of the unit cylinder to the fluid outlet of the unit control valve, to tilt the unit downwardly relative to the boom, (g) the hydraulic circuit being configured to provide passage means when the unit control valve is in the tilt-up position:

(i) for passing hydraulic fluid from the fluid pressure inlet of the unit control valve to the tilt-up chamber of the unit cylinder; and (ii) for passing hydraulic fluid from the tilt-down chamber of the unit cylinder to the fluid outlet of the unit control valve, to tilt the unit downwardly relative to the boom, (h) means operative when the unit control valve is moved from its neutral position to either tilt-up position or the tilt-down position:

(i) to block flow between the tilt-up chamber of the unit cylinder and the second secondary passage of the flow divider/combiner valve;

(ii) to block flow between the tilt-down chamber of the unit cylinder and the first secondary passage of the flow divider/combiner valve; and (iii) to provide passage means for passing hydraulic fluid from the fluid pressure inlet of the boom control valve to the boom-lower chamber of the boom cylinder when the boom control valve is in the boom-lower position, and for passing hydraulic fluid from the boom-lower chamber of the boom cylinder to the fluid outlet of the boom control valve when boom control valve is in the boom-raise position.

9. A control system for a lift boom pivotable with respect to a frame by a boom cylinder and a material handling unit pivotable with respect to the boom by a unit cylinder, the boom cylinder having a boom-raise chamber and a boom-lower chamber, the unit cylinder having the tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage, and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder;

(iv) for passing hydraulic fluid from the boom-raise chamber of the boom cylinder to the fluid outlet of the boom control valve, to maintain the unit in a preset orientation with respect to a reference plane as the boom is lowered, (f) the hydraulic circuit being configured to provide passage means when the unit control valve is in the tilt-down position:

(i) for passing hydraulic fluid from the fluid pressure inlet in the unit control valve to the tilt-down chamber of the unit cylinder;

(ii) for passing hydraulic fluid from the tilt-up chamber of the unit cylinder to the fluid outlet of the unit control valve, to tilt the unit downwardly relative to the boom, (g) the hydraulic circuit being configured to provide passage means when the unit control valve is in the tilt-up position:

(i) for passing hydraulic fluid from the fluid pressure inlet of the unit control valve to the tilt-up chamber of the unit cylinder; and (ii) for passing hydraulic fluid from the tilt-down chamber of the unit cylinder to the fluid outlet of the unit control valve, to tilt the unit downwardly relative to the boom, (h) the hydraulic circuit including electro-responsive valve means operative when actuated:

(i) to block flow from the tilt-down chamber of the unit cylinder to the first secondary passage of the flow divider/combiner valve;

(ii) to block flow from the tilt-up chamber of the unit cylinder to the second secondary passage of the flow divider/combiner valve; and (iii) to communicate the first secondary passage with the second secondary passage of the flow divider/combiner valve, and switch means for actuating said electro-responsive valve means.

10. A control system according to claim 9 wherein said switch means includes:

(i) a first pressure responsive switch configured to actuate the electro-responsive valve means when the fluid pressure at the tilt-up chamber of the unit cylinder exceeds a preset valve;

(ii) a second pressure switch configured to actuate the electro-responsive valve means when the fluid pressure at the tilt-down chamber of the unit cylinder exceeds a preset value.

11. A control system according to claim 10 wherein said switch means includes a third switch configured to actuate the electro-responsive valve means when the unit control valve is moved to either the tilt-up position or the tilt-down position.

12. A control system according to claim 11 wherein the switch means includes a manually operable switch for selectively actuating the electro-responsive valve means.

13. A control system according to claim 9 wherein the switch means includes a switch actuated in response to movement of the unit control valve to either the tilt-up or the tilt-down position.

14. A control system according to claim 9 wherein the switch means includes a manually operable switch for selectively actuating the electro-responsive valve means.

15. A control system for a lift boom pivotable with respect to a frame by a boom cylinder and a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage, and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder;

(iv) for passing hydraulic fluid from the boom-raise chamber of the boom cylinder to the fluid outlet of the boom control valve, to maintain the unit in a preset orientation with respect to a reference plane as the boom is lowered, (f) the hydraulic circuit being configured to provide passage means when the unit control valve is in the tilt-down position:

(i) for passing hydraulic fluid from the fluid pressure inlet in the unit control valve to the tilt-down chamber of the unit cylinder;

(ii) for passing hydraulic fluid from the tilt-up chamber of the unit cylinder to the fluid outlet of the unit control valve, to tilt the unit downwardly relative to the boom, (g) the hydraulic circuit being configured to provide passage means when the unit control valve is in the tilt-up position:

(i) for passing hydraulic fluid from the fluid pressure inlet of the unit control valve to the tilt-up chamber of the unit cylinder; and (ii) for passing hydraulic fluid from the tilt-down chamber of the unit cylinder to the fluid outlet of the unit control valve, to tilt the unit downwardly relative to the boom, (h) the hydraulic circuit including a two-position valve means movable between open and closed positions, the valve means being operative in the closed position:

(i) to block flow from the tilt-down chamber of the unit cylinder to the first secondary passage of the flow divider/combiner valve;

(ii) to block flow from the tilt-up chamber of the unit cylinder to the second secondary passage of the flow divider/combiner valve; and (iii) to communicate the first secondary passage with the second secondary passage of the flow divider/combiner valve, and means for moving the two-position valve means between the open and closed positions.

16. A control system according to claim 15 wherein said means for moving the two-position valve means includes:

(i) a first pressure responsive means configured to actuate the two-position valve means to the closed position when the fluid pressure at the tilt-up chamber of the unit cylinder exceeds a preset value;

(ii) a second pressure responsive means configured to actuate the two-position valve means to the closed position when the fluid pressure at the tilt-down chamber of the unit cylinder exceeds a preset value.

17. A control system according to claim 16 wherein said means for moving the two-position valve means includes means operated by the unit control valve when the unit control valve is moved to either the tilt-up position or the tilt-down position.

18. A control system for a lift boom pivotable with respect to a frame by a boom cylinder and a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom control valve having a fluid pressure inlet and a fluid outlet, the boom control valve being movable from a neutral position to a boom-raise position and to a boom-lower position, (b) a unit control valve having a fluid pressure inlet and a fluid outlet, the unit control valve being movable from a neutral position to a tilt-up position and to a tilt-down position, (c) a proportional flow divider/combiner valve having a primary passage, and a first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit control valve is in the neutral position and the boom control valve is in the boom-raise position:

(i) for passing hydraulic fluid from the fluid pressure inlet of the boom control valve to the boom-raise chamber of the boom cylinder;

(ii) for passing hydraulic fluid from the boom-lower chamber of the boom cylinder to the primary passage of the flow divider/combiner valve:

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the fluid outlet of the boom control valve, to maintain the unit in a preset orientation with respect to a reference plane as the boom is raised, (e) the hydraulic circuit being configured to provide passage means when the unit control valve is in the neutral position and the boom control valve is in the boom-lower position:

(i) for passing hydraulic fluid from the fluid pressure inlet of the boom control valve to the tilt-up chamber of the unit cylinder and to the second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder;

(iv) for passing hydraulic fluid from the boom-raise chamber of the boom cylinder to the fluid outlet of the boom control valve;

to maintain the unit in a preset orientation with respect to a reference plane as the boom is lowered (f) the hydraulic circuit being configured to provide passage means when the unit control valve is in the tilt-down position:

(i) for passing hydraulic fluid from the fluid pressure inlet in the unit control valve to the tilt-down chamber of the unit cylinder;

(ii) for passing hydraulic fluid from the tilt-up chamber of the unit cylinder to the fluid outlet of the unit control valve;

to tilt the unit downwardly relative to the boom;

(g) the hydraulic circuit being configured to provide passage means when the unit control valve is in the tilt-up position:

(i) for passing hydraulic fluid from the fluid pressure inlet of the unit control valve to the tilt-up chamber of the unit cylinder; and (ii) for passing hydraulic fluid from the tilt-down chamber of the unit cylinder to the fluid outlet of the unit control valve, to tilt the unit downwardly relative to the boom.

19. A control system according to claim 18 wherein the boom control valve is a meter-out type valve configured to progressively change the volume of fluid flow from the boom-raise chamber of the boom cylinder to the fluid outlet of the boom control valve as the boom control valve is moved from the neutral to the boom-lower position.

20. A control system according to claim 18 wherein the boom control valve is a four position directional control valve operative in the fourth position to communicate the boom-raise chamber and the boom-lower chamber with the fluid outlet of the boom control valve and allow the unit to float.

21. A control system according to claim 18 including load holding valve means for regulating flow from the boom-raise chamber of the boom cylinder, the load holding valve means being normally closed to hold the boom against downward movement and pilot operated to allow flow from the boom-raise chamber when the fluid pressure in the boom-lower chamber reaches a preselected value.

22. A control system according to claim 18 wherein said boom control valve is a directional control valve with a meter-out spool.

23. A hydraulic control system for raising and lowering a lift boom pivotable with respect to a frame by a boom cylinder and for controlling leveling of a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom direction-control valve having first and second boom control ports, the boom direction-control valve being selectively movable from a neutral position to a boom-raise position passing fluid from a pressurized source to the first boom control port, and to a boom-lower position passing fluid from the pressure source to the second boom control port, (b) a unit direction-control valve having first and second unit control ports, the unit direction-control valve being selectively movable from neutral position to a tilt-up position passing fluid from the pressure source to the first unit control port and to a tilt-down position passing fluid from the pressure source to the second unit control port, (c) a proportional flow divider/combiner valve having a primary passage and first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit direction-control valve is in the neutral position and the boom direction-control valve is in the boom-raise position:

(i) for passing hydraulic fluid from the first boom control port to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the second boom control port, to maintain the unit in a preset orientation with respect to a reference plane as the boom is raised;

(e) the hydraulic circuit being configured to provide passage means when the unit direction-control valve is in the neutral position and the boom direction-control valve is in the boom-lower position:

(i) for passing fluid from the second boom control port to the tilt-up chamber of the unit cylinder and to second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder, and (iv) for passing hydraulic fluid from the boom-raise chamber of the boom cylinder to the first boom control port to maintain the unit in a preset orientation with respect to a reference plane as the boom is lowered, (f) the hydraulic circuit including a leveling disengagement valve means movable between open and closed positions, and means for moving the disengagement valve means between said open and closed positions, the leveling disengagement valve being operative in the closed position:

(i) to block flow from the tilt-down chamber of the unit cylinder to the first secondary passage of the flow divider/combiner valve and;

(ii) to block flow from the tilt-up chamber of the unit cylinder to the second secondary passage of the flow divider/combiner valve and;

(iii) to communicate the first secondary passage with the second secondary passage of the flow divider/combiner valve.

24. A hydraulic control system for raising and lowering a lift boom pivotable with respect to a frame by a boom cylinder and for controlling leveling of a material handling unit pivotable with respect to the boom by a unit cylinder, the boom cylinder having a boom-raise chamber and a boom-lower chamber, the unit cylinder having a tilt-up chamber and a tilt-down chamber, the control system comprising:

(a) a boom direction-control valve having first and second boom control ports, the boom direction-control valve being selectively movable from a neutral position to a boom-raise position passing fluid from a pressurized source to the first boom control port, and to a boom-lower position passing fluid from the pressure source to the second boom control port, (b) a unit direction-control valve having first and second unit control ports, the unit direction-control valve being selectively movable from neutral position to a tilt-up position passing fluid from the pressure source to the first unit control port and to a tilt-down position passing fluid from the pressure source to the second unit control port, (c) a proportional flow divider/combiner valve having a primary passage and first secondary passage and a second secondary passage, the flow divider/combiner valve being configured to divide a single inlet stream from the primary passage in a preset ratio into two separate outlet streams at the first and second secondary passages and, reversely, to combine two separate inlet streams from the first and second secondary passages in said preset ratio into a single outlet stream at the primary passage, (d) an hydraulic circuit configured to provide passage means when the unit direction-control valve is in the neutral position and the boom direction-control valve is in the boom-raise position:

(i) for passing hydraulic fluid from the first boom control port to the boom-raise chamber of the boom cylinder;

(ii) for passing hydraulic fluid from the boom-lower chamber of the boom cylinder to the primary passage of the flow divider/combiner valve;

(iii) for passing hydraulic fluid from the first secondary passage of the flow divider/combiner valve to the tilt-down chamber of the unit cylinder; and (iv) for passing hydraulic fluid from the tilt-up chamber of the unit cylinder and from the second secondary passage of the flow divider/combiner valve to the second boom control port, to maintain the unit in a preset orientation with respect to a reference plane as the boom is raised;

(e) the hydraulic circuit being configured to provide passage means when the unit direction-control valve is in the neutral position and the boom direction-control valve is in the boom-lower position:

(i) for passing fluid from the second boom control port to the tilt-up chamber of the unit cylinder and to second secondary passage of the flow divider/combiner valve;

(ii) for passing hydraulic fluid from the tilt-down chamber of the unit cylinder to the first secondary passage of the flow divider/combiner valve;

(iii) for passing hydraulic fluid from the primary passage of the flow divider/combiner valve to the boom-lower chamber of the boom cylinder, and (iv) for passing hydraulic fluid from the boom-raise chamber of the boom cylinder to the first boom control port to maintain the unit in a preset orientation with respect to a reference plane as the boom is lowered, (f) the hydraulic circuit including a leveling disengagement valve means movable between open and closed positions, and means for moving the disengagement valve means between said open and closed positions, the leveling disengagement valve being operative in the closed position:

(i) to block flow from the tilt-down chamber of the unit cylinder to the first secondary passage of the flow divider/combiner valve and;

(ii) to block flow from the tilt-up chamber of the unit cylinder to the second secondary passage of the flow divider/combiner valve and;

(iii) to communicate the first secondary passage with the second secondary passage of the flow divider/combiner valve, (g) the hydraulic circuit including passage means operative when the leveling disengagement valve means is in the closed position, to provide passage means for passing fluid between the first unit control port and the tilt-down chamber of the unit cylinder and for passing fluid between the second unit control port and the tilt-up chamber of the unit cylinder.

* * * * *